US005599262A

United States Patent [19]

Shih

[11] Patent Number: 5,599,262

[45] Date of Patent: Feb. 4, 1997

[54] SHAKE AND TWIST EXERCISER

[76] Inventor: Ching-Fu Shih, 31-42, Nan Tun Road, Sec. 2, Taichung, Taiwan

[21] Appl. No.: 576,687

[22] Filed: Dec. 21, 1995

[51] Int. Cl.[6] ..... A63B 22/14

[52] U.S. Cl. ..... 482/147; 482/146

[58] Field of Search ..... 482/146, 147, 482/70, 79

[56] References Cited

U.S. PATENT DOCUMENTS 4,391,441 7/1983 Simjian ..... 482/147

FOREIGN PATENT DOCUMENTS 2533038 2/1977 Germany ..... 482/146
2549286 5/1977 Germany ..... 482/146

*Primary Examiner*—Lynne A. Reichard
*Attorney, Agent, or Firm*—Burns, Doane, Swecker & Mathis, LLP

[57] ABSTRACT

A body twist exerciser, including a base, a guardrail mounted on the base, a rotatable hollow box-type rotating arm having one end pivoted to a fixed shaft in the center of the base, and a rotary disc rotatably supported by the center part thereof on the free end shaft of the rotating arm. A transmission mechanism is located in the hollow interior of the rotating arm. The transmission mechanism includes a drive sprocket fixed to the free end shaft of the rotating arm and located below the rotary disc. A driven sprocket is spaced-apart from and mounted side by side with this drive sprocket on a revolving shaft approximating the base end inside the rotating arm. A loop-like transmission chain is wound between the drive and driven sprockets and a transmission gear is mounted on the revolving shaft below the driven sprocket. An intermediate gear is rotatably disposed on an intermediate shaft between the fixed shaft and the revolving shaft to be engaged with the transmission gear. A fixed gear disposed on the fixed shaft is engaged with the intermediate gear and works as a sun gear. When the rotary disc revolves, the drive sprocket mounted on the same shaft as the rotary disc by way of the transmission chain and the driven sprocket driving the transmission gear is brought into rotation around the fixed gear through the intermediary of the intermediate gear. This configuration permits the entire rotating arm to rotate in a corresponding direction as the rotary disc.

5 Claims, 2 Drawing Sheets

SHAKE AND TWIST EXERCISER

BACKGROUND OF THE INVENTION

1. Field of the Invention

The present invention relates to a body shake and twist exerciser and, in particular, to improvements relating to the transmission mechanism in a vertical type shake and swing exerciser for waist twist exercises by the user.

2. Prior art of the Invention

There are many kinds of equipment used in waist twist exercises, of which the most commonly seen are hula hoops and twist discs. In a known calisthenics apparatus for hip twisting waist girdling exercises, the transmission mechanism consists of a cross bar (rotating arm) having a downward projecting shaft on one end capable of being freely rotatably engaged in a bearing seat at the center of the base and an upward projecting bearing seat on the other end. A rotating disc is freely rotatably engaged in the upward projecting bearing seat on the one end of the cross bar by a central downward projecting shaft. When a user holds onto a guardrail set up above and around the base and steps with both feet onto the rotating disc to twist and swing the waist to the left and right sides, this rotating disc is rotated with the bearing seat on the free end of the cross bar as the center of rotation. Because of the human body weight and the forces produced by rotative force of the rotating disc, the cross bar also rotates about the bearing seat of the base. In other words, relative to the center of the base this rotating disc appears to be eccentric and while the disc rotates about its center it also rotates around the base center. This type of motion is frequently observed in physical teaching game apparatus in science museums and in rotary cups in children's amusement parks.

When the aforesaid exerciser with the above-described mechanism is actually used for exercises it will be found that because there is no relation between the rotating disc and the cross bar (rotary arm), each performs rotation about its axis in an arbitrary and irregular direction and manner. As a result, the user cannot easily maintain a standing position in a specified direction leading to uncontrollable body distortion. Particularly, as the speed of the separate rotary motion of the two rotating parts increases this will result in the movement being difficult to follow, the movement getting confused, the body of the user being unable to stand firmly and the user will have a tendency to fall off. To prevent the user from falling off, it has been suggested to mount an additional waist girdling ring having three directional supports to maintain the user's the center of gravity equilibrium.

SUMMARY OF THE INVENTION

In view of the above, the applicant investigated making the rotary disc and the rotating arm (the cross bar) perform related, synchronous and same directional restricted motion, in order to eliminate the arbitrary rotary motion of the known devices and through intensive design has accomplished the present invention.

Accordingly, an object of the present invention is to provide a shake and twist exerciser having a rotary disc and a rotating arm which perform related synchronous restricted motion of constant speed ratio through the linkage of a transmission mechanism, thereby permitting the user to maintain the body in a balanced position facing toward a specified direction and maintaining a center of gravity during exercises. In addition, the present invention makes the use and control of a twist exerciser easier and enhances safety.

A further object of the present invention is to provide a shake and twist exerciser having a brake device for controlling the rotating speed of the rotating arm, thereby permitting the user to appropriately adjust the rotating arm and further the speed of rotation in the rotary disc in conformance with the user's own exercise conditions.

An additional object of the present invention is to provide a shake and twist exerciser without having to use a waist girdling ring for maintaining the center of gravity of the user's body.

BRIEF DESCRIPTION OF THE DRAWINGS

Other objects, features and advantages of the present invention will be apparent from the following detailed description of the embodiments by reference to the accompanying drawings, in which.

DETAILED DESCRIPTION OF THE PREFERRED EMBODIMENTS

Figure 1:
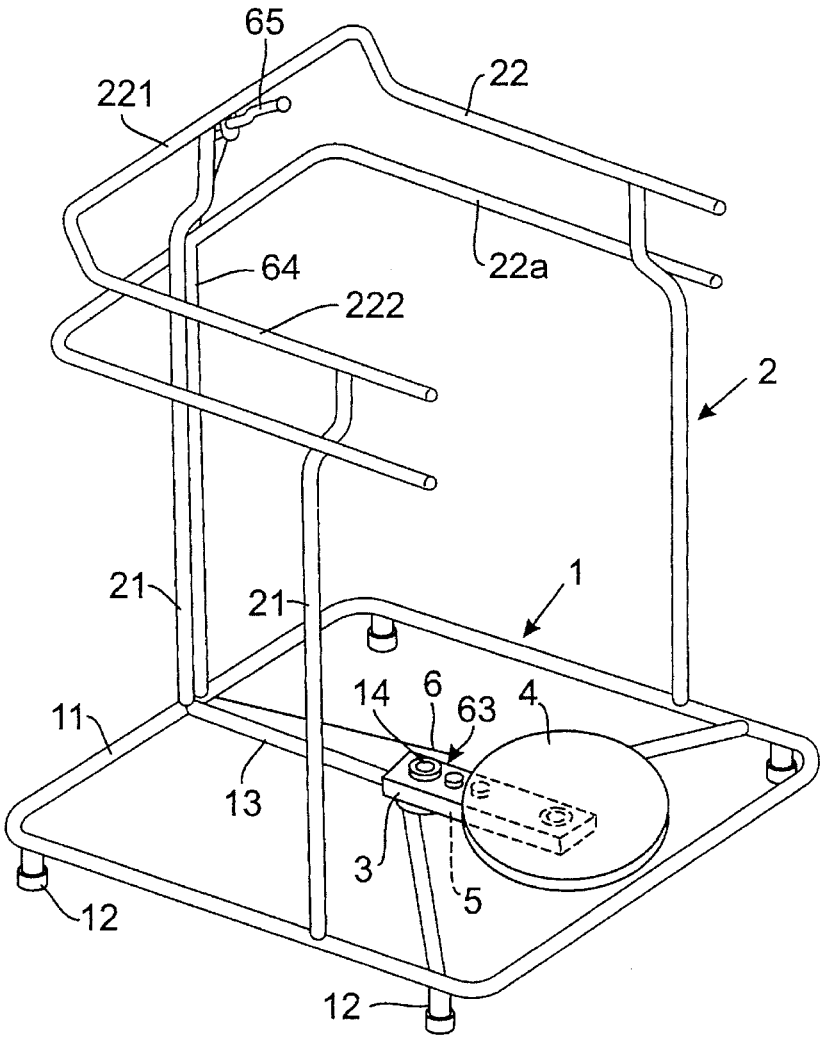
FIG. 1 represents a perspective view of an embodiment of the present invention.

As shown in FIG. 1, the shake and twist exerciser of the present invention comprises a metallic base 1, a guardrail 2 mounted on the base 1, a hollow box type rotating arm 3 having one end thereof pivotally mounted on a fixed shaft at the center of the base 1, a rotary disc 4 rotatable supported by the central portion thereof on the free end of the rotating arm 3, a transmission mechanism 5 disposed in the hollow part of the rotating arm 3 and a brake 6 disposed on the fixed shaft of the base 1.

Preferably, the base 1 is made of metal tubing and formed into a ring shaped frame body 11 having a shape such as square circular or polygonal. On the bottom of the base 1 are several (four in the present embodiment) support legs 12 and in the center are several (three in the present embodiment) fixed shafts 13 extending from the surrounding ring shaped frame body 11 toward the center and meeting at a radial supporting rod 14 of the center. Again, welded to the ring frame body 11 is a guardrail 2 formed by combination of several (three in the present embodiment) appropriately spaced-apart upright rods 21 vertically upwardly extending and having the ends slightly inwardly bent and at least two horizontal guard bars 22, **22*a* in the form of a truncated "U". The guard bars 22, 22*a* are spaced apart on the upper ends of the upright rods 21 and have an opening on one side. The forward central portion 221 of the upper guard bar 22 is slightly elevated and this together with two lateral side portions 222** forms a two-section handrail as well as a front guardrail for holding onto by the user during use.

Figure 2:
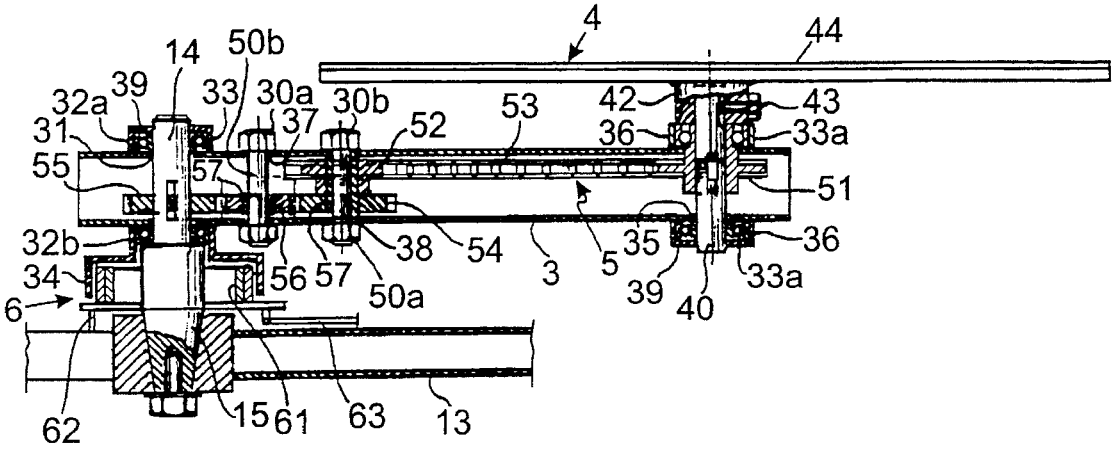
FIG. 2 represents a partial sectional view of the major mechanism portion of the present invention.

The rotating arm 3, as shown in FIG. 2, is an oblong flat box made of a metal sheet, its base end portion, that is, the base pivoted-end portion is provided on the upper and lower side thereof with two coaxial opposing shaft holes 31. Each of the shaft holes 31 is provided with bearings 33 on an outer edge thereof, which are attached by bearing receiving parts 32*a*, 32*b* to the upper and lower sides of the rotating arm 3. Extending downwardly from the lower bearing receiving part 32*b* is an expanded-bore cylindrical part acting as a brake drum 34. The upper and lower sides of the free end of the rotating arm 3 are also provided with two coaxial opposite shaft holes 35. Each of the shaft holes 35 is provided with bearings 33*a* attached to the upper and lower sides of the rotating arm 3. In addition, on the upper and lower sides close to the base end portion of the rotating arm 3 two pairs of shaft holes 37, 38 are provided which are located at positions where the center positions are staggered. The shaft holes 37 and 38 receive therein two central counter shafts 50*a* and 50*b* which are fixed at both ends respectively by nuts 30*a*, 30*b* and are parallel to the fixed shaft 14. This rotating arm 3 is engaged by its base end bearing 33 and shaft hole 31 on the upper end of the fixed shaft 14. The fixed shaft 14 is inserted in the taper hole 15 of the base 1 by the conical lower shaft end. The rotating arm 3 is thus smoothly freely rotatable relative to the fixed shaft 14. Inserted, in the bearing 33*a* and shaft hole 35 at the free and of the rotating arm 3 is a shaft 40 rotatable in relation to the arm 3 and having the upper end protruding out above the upper portion of the arm 3. Preferably, the bearing receiving parts 32*a*, 36 are covered with dust protective lids 39.

The rotary disc 4 is a rounded disc body having a radius less than the length of the rotating arm 3 and on the upper side thereof being preferably formed with a slipping protection surface or mounted with a layer of rubber slip protection material 41 to prevent the user standing on the disc body from slipping off. On the center of the bottom rotary disc 4 a cylindrical shaft hub 42 is mounted. Through the engagement of a central hole of this shaft hub 42 over the upper end of the shaft 40 and also by means of a screw 43 radially passing through the screw hole 44 on the side wall of the shaft hub 42 until its front end presses against the smoothed part of the shaft 40, the rotary disc 4 is fixed on and removable relative to the shaft 40. In this way, the rotary disc 4 is supported on the free end of the rotating arm 3 and is freely rotatable by the shaft 40.

Figure 3:
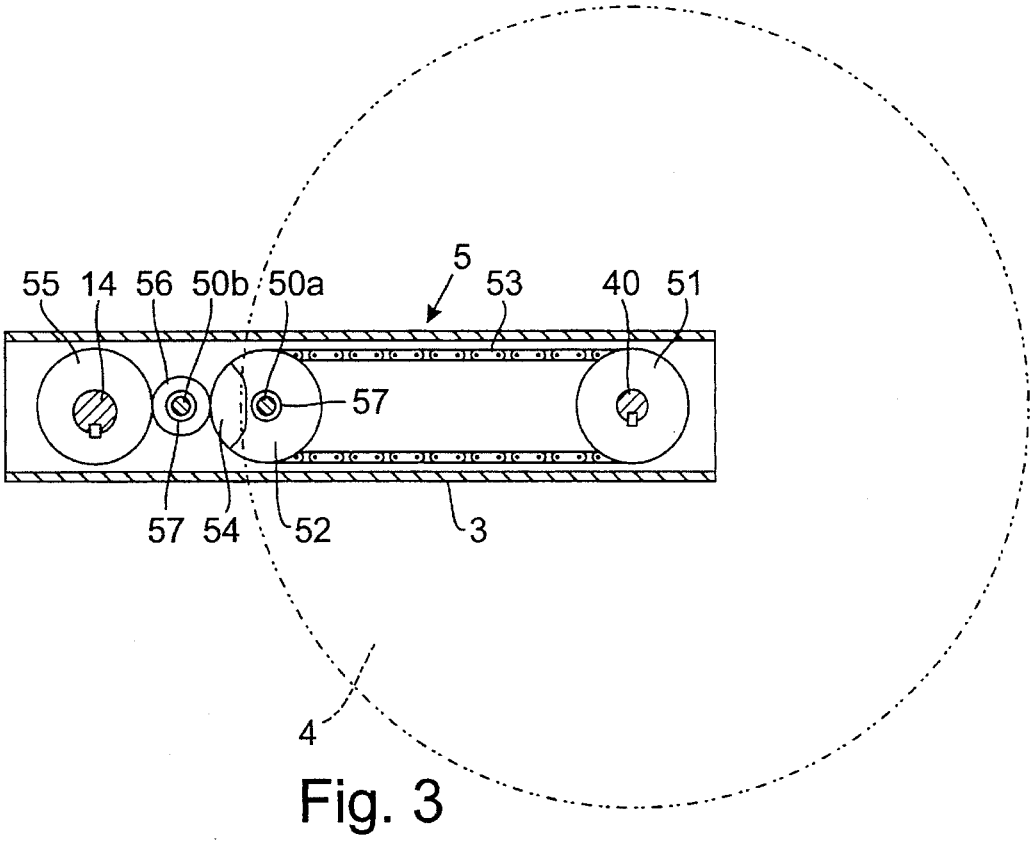
FIG. 3 represents a partially cut open top view of the major mechanism portion of FIG. 2.

The transmission mechanism 5, as shown in FIGS. 2 and 3, is located inside the hollow part of the rotating arm 3 and comprises a drive sprocket 51 fixed on the shaft 40 at the free end of the rotating arm, a driven sprocket 52 spaced-apart from and rotatably mounted side by side with the drive sprocket 51 on the intermediate layshaft (driven shaft) 50*a* which is parallel to the shafts 14, 40 by means of an ordinary bearing 57, a transmission chain 53 wound around both the drive and driven sprockets 51, 52, a drive gear 54 combined with the lower part of the driven sprocket 52 to form a single body and capable of rotating together on the layshaft 50*a*, an intermediate gear 56 rotatably mounted on the intermediate layshaft 50*b* by a bearing 57 to be brought into engagement with the drive gear 54, and a fixed gear 55 rigidly mounted on the fixed shaft 14 to be brought into engagement with the intermediate gear 56. The sprockets 51 and 52 preferably have the same number of teeth, and since the gear 54 revolves as a single body with the sprocket 52 it may have the same number of teeth as the sprocket 52 or it may have smaller or greater number of teeth than the sprocket 52. Also, for the intermediate gear 56 any appropriate number of teeth may be adopted, this is because this intermediate gear 56 can rotate on its own axis and is also able to revolve relative to the fixed gears 55 and therefore with respect to the gear 55 it is a planetary gear.

In principle, the relation between the numbers of teeth in the two gears 54, 55 is the same number of teeth and no matter what number of teeth the intermediate gear 56 has, the rotational relationship between the rotary disc 4 and the rotating arm 3 will keep a relation where the direction of rotation is opposite and the speed is 1:1. However, the number of teeth in the gear 54 may also be selected to be either smaller or greater than the number of teeth in the fixed gear 55. When the numbers of teeth in the two gears 54, 55 are the same, for one rotation of the gear 54 on its own axis the rotating arm 3 also revolves around the gear 55 in the opposite direction for one rotation through the transmission of the gear 56. This will enable the rotary disc to maintain a fixed direction at whatever degree the rotating arm 3 has rotated to and thereby will permit the user to maintain facing one direction and balance more easily. If the gear 54 has fewer teeth than the gear 55, for example, when the number of teeth in the gear 54 is half the number of teeth of the gear 55, then for two revolutions of the gear 54 the gear 55 makes one revolution. If the number of teeth in the gear 54 is somewhat larger, for example, when the number of teeth in the gear 54 is two thirds the number of teeth of the gear 55, then for 1½ revolutions of the gear 54 the gear 55 makes one revolution. Under these two conditions, it will not be possible to maintain the relative directions of the rotary disc 4 and the base 1 as in the aforesaid state and the user will have to rely on their owns body to maintain balanced.

The brake 6 is located between the base end of the rotating arm 3 and the fixed shaft 14 of the base, including the aforesaid brake drum 34 and expanding brake shoe 61. One end of this brake shoe 61 is fixed close to the fixed shaft 14 of the base 1 by a fixing pin 62, while the other end of the brake shoe is fixed to one end of a brake pull rod 63 which is capable of forcing the brake shoe 61 to expand outwardly to contact the inner circumferential face of the brake drum 34 and thus brake the brake drum 34 (rotating arm 3). The other end of the brake pull rod 63 is connected to one end of a brake handle 65 by a brake rope 64 passing through the base 1 and a central upright rod 21 of the guardrail 2. The brake handle is pivotally attached to the guard bar 22.

Figure 4:
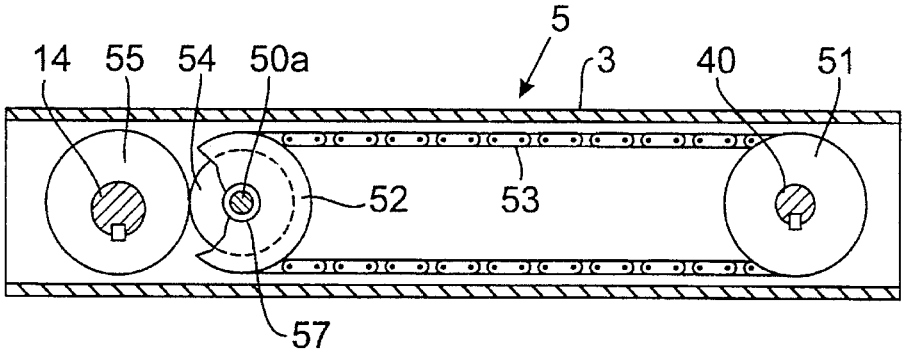
FIG. 4 represents a schematic view of another embodiment of the transmission mechanism of the present invention.

In this embodiment the brake 6 is made of the form of an expanding brake shoes however, it is apparent that brakes of other known forms, such as, a bell type, or an out-connected skid bar and a grip, may be used in substitution. Furthermore, in the present embodiment the transmission mechanism 5 is a sprocket chain set transmission type, however, this may also be replaced with a synchronizing belt and synchronizing gear set or gear train assembly, or V-type belt and belt gear transmission. In order that the transmission is positive and efficient, it is preferable to use chain and chain gear type or synchronizing belt and gear type. Shown in FIG. 4 is another example of the present invention where the gear 55 and gear 54 are directly in engagement and there is no provision of an intermediate gear 56 in between. With such a structure, the directions of rotation of the rotary disc 4 and the rotating arm 3 are the same and the usability is low. There is, however, a certain link action between motions of the two and no individual irregular motion produced as is with the conventional device. Furthermore, the bearing receiving parts 32*a*, 36 are formed projecting out of the rotating arm, however, if the inside space of the rotating arm 3 is of a sufficient height such receiving parts may then be changed to an inside recessing type so that the outer sides of the bearings and the upper and lower plain surfaces of the rotating arm 3 can be made flush. In addition, the two layshafts 50*a*, 50*b* can also be changed into a rotatable structure supported by rings like the two ends of the shaft 40, however, in this case the sprocket 52 with gear 54 and gear 56 must be separately fixed to the layshafts 50*a* and 50*b*.

In the following, the body twist exerciser of the present invention will now be described in relation to conditions of use and its operation.

When in use, the user steps with both feet on the rotary disc 4 and the two hands of the user hold onto the handle (guardrail) 22. Simultaneously with one of the hands gripping gently on the brake handle 65 to allow body to stand firmly, the user then twists from the waist to the lower half of the body of the two legs to cause the rotary disc 4 to rotate about the shaft 40 in one direction (depending upon the direction in which the user twists, either positive direction or reverse direction will do). By way of the chain 53 the sprocket 51 starts to drive the driven sprocket 52 to rotate in the same direction. The gear 54 which is attached to the same shaft as the sprocket 52 drives the intermediate gear 56 to rotate around the fixed gear 55 thereby bringing the rotating arm 3 into movement to rotate in a direction opposite to the direction of rotation of the rotary disc 4 around the shaft 14. At this time, if the number of teeth in the gears 54 and 55 have a ratio of 1:1 the rotating disc 4 will always maintain a fixed direction no matter what position the rotating arm 3 has turned to during rotation.

As for the user, since this will enable a person to always face a constant direction during movement the person can readily keep their balance and control the movement of their body. Continuing in this way the twisting of the waist portion of the user enables the rotary disc 4 to rotate on the one hand, and by the rotating arm 3, on the other hand, to revolve around the shaft 14 so that swinging motion can be performed. During the exercises, if the speed of revolution in the rotary disc 4 or the rotating arm 3 becomes faster than desired and the user finds it difficult to keep up with or maintain their balance, the user may then operate the brake handle 65 and control the brake drum 34 by the brake rope 64 to thereby cause the speed in the rotating arm 3 to slow down, thus the speed in the rotary disc 4 is also slowed down. The user can now perform exercises suitable to the action and speed of the user's choice. It is even possible to slow down the brake drum 34 to a complete halt and bring the entire machine to a stop. If, however, the user changes the direction of waist twisting exercises causing the rotary disc 4 to rotate in another direction, the rotating arm 3 will also follow and rotate in a different direction.

The body twist exerciser of the invention is constructed and the operation is such that when the user steps on the rotary disc to exercise, the rotating arm will perform relatedly the synchronous rotational motion of a specified speed ratio by way of the drive mechanism. At the same time, with the brake the speed of the rotating arm can further be controlled at will by the user. Unlike the conventional device where the rotary disc and the rotating arm perform independent and unrelated, arbitrary rotations and where there is no speed controlling means, which is therefore likely to result in the user being unable to comply with the motion and to maintain the body in balance and from easily falling down, the exercise device of the present invention can be easily adjusted in compliance with requirements of the user and is therefore a most useful and safe device.

The foregoing is a description of the preferred embodiment of the invention and it should be understood that variations and modifications may be made thereto without departing from the true spirit of the invention as defined in the appended claims.

I claim:

1. A body shake and twist exerciser, comprising:

a base, a guardrail disposed on said base, a rotatable, hollow box-type rotating arm having one end pivoted to a fixed shaft at the center of said base, a rotary disc rotatably supported at a central portion of the rotary disc on a free end shaft of said rotating arm, and a transmission mechanism comprising:

a drive sprocket fixed on the free end shaft of said rotating arm and located below said rotary disc, a driven sprocket spaced-apart from and mounted side by side with said drive sprocket on a revolving shaft near a base end of said rotating arm, a transmission member connecting said drive and driven sprockets, a transmission gear mounted on said revolving shaft below said driven sprocket, an intermediate gear rotatably mounted on a layshaft between said fixed shaft and revolving shaft to be engaged with said transmission gear, and a fixed gear mounted on said fixed shaft said intermediate gear to work as a sun gear;

wherein when said rotary disc revolves, the drive sprocket and said transmission member move driving the driven sprocket and driving said transmission gear through the intermediate gear and further permitting the entire rotating arm to rotate in a corresponding direction to a direction of rotation of the rotary disc.

2. The body shake and twist exerciser according to claim 1, wherein said body twist and swing exerciser further includes a brake for controlling the speed of rotation of said rotating arm, said brake comprising a brake drum of a concentric shape located in a bearing portion of said rotating arm and a brake rope and pull rod controllable brake shoe located in the vicinity of the fixed shaft of said base and acting in conjunction with said brake drum.

3. The body shake and twist exerciser according to claim 1, wherein the number of teeth in the transmission gear and the number of teeth in the fixed gear of said transmission mechanism are the same.

4. The body shake and twist exerciser according to claim 1, wherein the number of teeth in the transmission gear and the number of teeth in the fixed gear of said transmission mechanism are not the same.

5. The body shake and twist exerciser according to claim 1, wherein said transmission member comprises, a synchronous belt device, a V-type belt device, or a train of gearings.

* * * * *